US006540082B2

(12) United States Patent
Peterson

(10) Patent No.: US 6,540,082 B2
(45) Date of Patent: Apr. 1, 2003

(54) MEDICINE DISPENSING APPARATUS

(75) Inventor: Darin A. Peterson, Torrance, CA (US)

(73) Assignee: Meds Made Easy, Torrance, CA (US)

( * ) Notice: Subject to any disclaimer, the term of this patent is extended or adjusted under 35 U.S.C. 154(b) by 0 days.

(21) Appl. No.: 09/569,211

(22) Filed: May 11, 2000

(65) Prior Publication Data

US 2002/0070142 A1 Jun. 13, 2002

(51) Int. Cl.[7] ..... B65D 83/04
(52) U.S. Cl. ..... 206/534; 206/232
(58) Field of Search ..... 206/530, 534, 206/538, 539, 540, 37, 38, 232, 459.5

(56) References Cited

U.S. PATENT DOCUMENTS

| | | | | | |
|---|---|---|---|---|---|
| 4,038,937 | A | * | 8/1977 | Moe | 206/538 |
| 4,318,477 | A | * | 3/1982 | Kerpe | 206/534 |
| 4,496,051 | A | * | 1/1985 | Ortner | 206/38 |
| 4,733,807 | A | * | 3/1988 | Porter et al. | 206/37 |
| 4,749,085 | A | * | 6/1988 | Denney | 206/534 |
| 4,811,845 | A | * | 3/1989 | Baggett | 206/534 |
| 4,872,559 | A | * | 10/1989 | Schoon | 206/534 |
| 4,889,237 | A | * | 12/1989 | Brandon | 206/534 |
| 4,918,604 | A | * | 4/1990 | Baum | 283/67 |
| 5,174,451 | A | * | 12/1992 | Niven | 206/534 |
| 5,330,055 | A | * | 7/1994 | Kendra et al. | 206/534 |
| 5,390,796 | A | * | 2/1995 | Kerfoor, Jr. | 206/534 |
| 6,036,017 | A | * | 3/2000 | Bayliss | 206/534 |
| 6,082,544 | A | * | 7/2000 | Romick | 206/534 |

OTHER PUBLICATIONS

"Antiretrovial Medications for HIV/AIDS", GlaxoSmithKline, 1998.
"Combination Therapy Pill Chart", GlaxoSmithKline, 1997.
"Daily Dosing of Available Antiretrovial Agents", ROXANE Laboratories, Inc., 1998.

* cited by examiner

*Primary Examiner*—Luan K. Bui
(74) *Attorney, Agent, or Firm*—Cooley Godward LLP

(57) ABSTRACT

A medicine dispensing apparatus includes a medicine tray, the tray including at least one closeable compartment, an information card, the information card containing at least a photograph of medication to be taken by a patient and textual information concerning the medication and a coupling means for attaching the medicine tray to the information card.

7 Claims, 4 Drawing Sheets

MEDICINE DISPENSING APPARATUS

BACKGROUND OF THE INVENTION

1. Field of the Invention

The present invention relates to the field of medical devices, and more particularly, a medicine dispensing apparatus which provides a patient a dispensing tray in combination with a written and graphical description of medication which must be taken on a pre-determined schedule.

2. Prior Art

In many modern medical applications it is common for patient to be prescribed a large number of different medications by their doctor. It is not uncommon for a patient to be prescribed five or more different medications to treat a single disease or other medical condition. These medications typically must be taken on a specific schedule. This medication is usually in the form of pills or capsules which must be swallowed by the patient. When the disease or condition is being treated on an outpatient basis, it is the responsibility of the patient to take all of the medications at the appropriate times.

It is usually the case that all of the medications are not taken according to the same schedule. For example, some medications must be taken once a day. Other medications have a regimen where they are taken two or more times per day. Other medications are taken less frequently, for example every other day, or once per week. Keeping track of each medication, and the times on which it must be taken is extremely important. If a particular medication is missed, severe health consequences, and even death can occur for the patient. The patient must therefore have an effective means of keeping track of the times and days when each medication must be taken.

It is known in the prior art to provide a medicine dispensing tray for the patient. The tray is divided up into a number of compartments (which may correspond to the days of the week). The patent can then divide up the medication to be taken into the different compartments.

This medicine tray of the type known in the prior art does not solve all of the problems associated with the dispensing of multiple medications, however. The patent is required to divide up the medication themselves. In many States—such as California—the law requires that all medication be accompanied by a label which includes specified information concerning the medication. This information typically includes the dosage, patient name and dispensing schedule. In the prior art, the labeling information is placed on the individual bottles in which the medicine is sold. As a result, a dispensing pharmacy is not able to give the medication to the patient pre-packaged in the individual compartments of the medicine tray.

In some instances, the symptoms suffered by the patient may include dementia, loss of memory or decreased mental capacity. In these situations, it is obvious that requiring the patient to divide up their own medication could present serious difficulties.

Another problem arises in that the patient, typically being a layman without medical training or experience, is not easily able to visually differentiate between different types of pills or capsules. Therefore, if the patient's pills become mixed or spilled, it can be a difficult task for the patient to sort out the medications and be able to resume their dosage regimen.

The present invention overcomes the limitations of the prior art by providing a medicine dispensing apparatus which provides a patient with an easy and effective method of keeping track of medicine which must be taken. With the present invention, the patient is provided with a multi-dose medication tray with an attached visual and written description of the various pills and capsules which have been prescribed, the schedule on which the medicines must be taken, and a diagram representing the multidose tray showing where each medication is placed in the tray for reference.

SUMMARY OF THE PRESENT INVENTION

The present invention provides a medicine dispensing apparatus which is intended and designed to overcome the limitations of the prior art. The apparatus is intended to be used in instances where a patient has been prescribed multiple different medications which must be taken on a fixed schedule. With the present invention, a dispensing tray includes a number of different compartments. These compartments may correspond to the days of the week. Coupled to the tray is an information card which provides a patient with a written and visual description of the medicine to be taken and a diagram of the tray showing where each medication is located in the tray.

DETAILED DESCRIPTION OF THE PREFERRED EMBODIMENT

A medicine dispensing apparatus will be described. In the following description, for the purposes of explanation, specific construction details, arrangements, and materials are set forth in order to provide a more thorough understanding of the present invention. It will be apparent to those skilled in the art, however, that the present invention may be practiced without these specific details. In other instances, well known manufacturing methods and structures have not been described in detail so as not to obscure the present invention unnecessarily.

Figure 1:
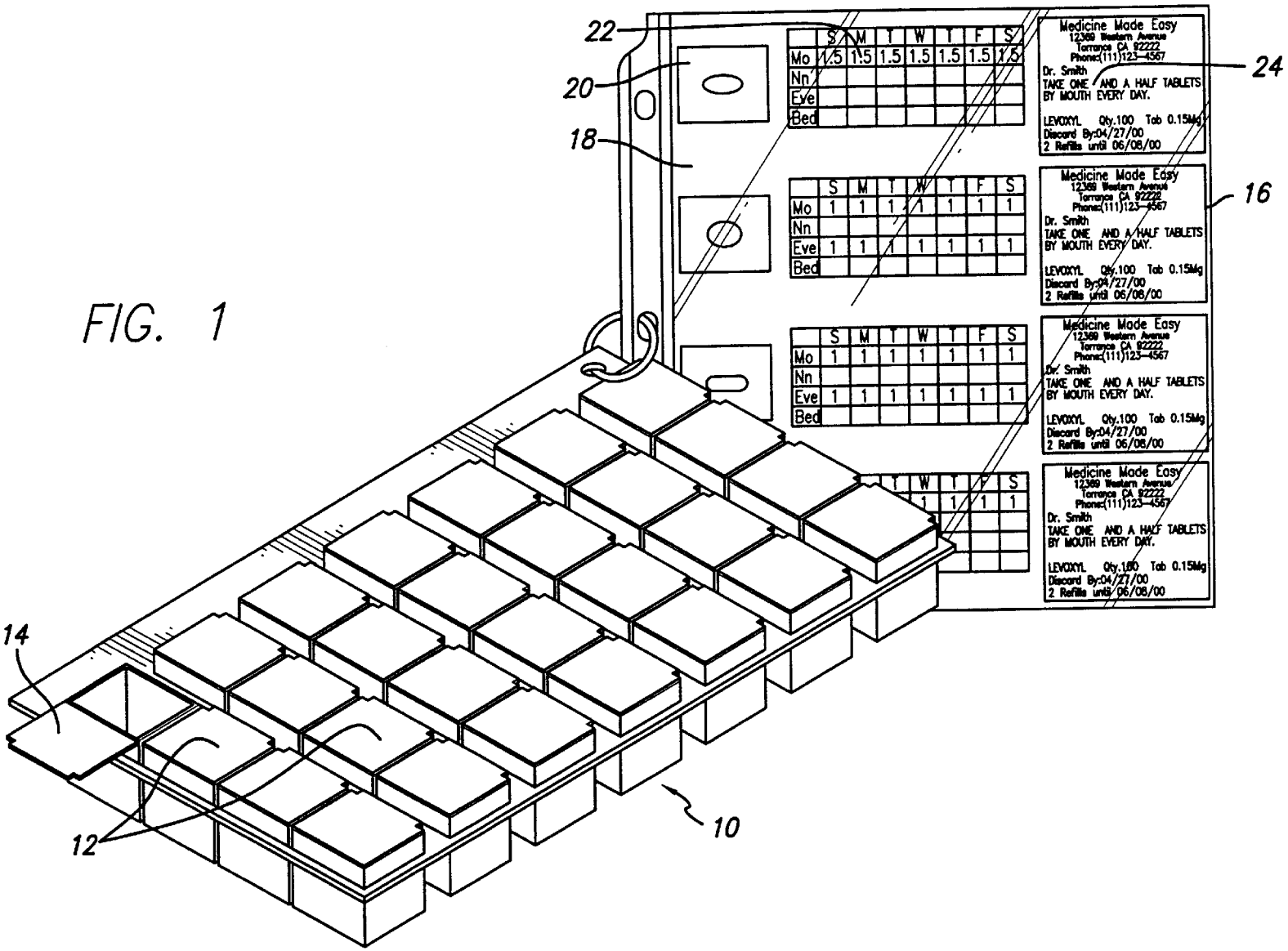
FIG. 1 is a perspective view of the preferred embodiment of the medicine dispensing apparatus of the present invention.

Referring first to FIG. 1, a perspective view of the preferred embodiment of the present invention is shown. A medicine tray 10 is provided. In the preferred embodiment, the tray is manufactured from an inert material such as plastic, which will not react with the medicine to be taken. The tray 10 has formed into it a plurality of compartments 12. The compartments are of such a size that they can accommodate a number of different medications in the form of pills or capsules (not shown in FIG. 1). Each compartment includes a lid 14 which may be snapped closed in order to keep the medication in the compartments without spilling.

The exact number of compartments 12 in the tray 10 can vary. In the preferred embodiment, there are seven compartments 12 formed into the tray, each corresponding to a day of the week. If desired, the lids of each compartment may be embossed with the days of the week (Sunday, Monday, Tuesday, etc.). It will be apparent to those skilled in the art, however, that the tray may include a smaller or larger number of compartments without departing from the overall spirit and scope of the present invention. For example, the tray 10 may have five compartments or fourteen compartments (corresponding to a two-week schedule for taking medication).

Attached to the medicine tray is an information card 16. The information card includes graphical and written information concerning the medicine to be taken. The information card is fixed to the to the medicine tray so that it is not easily detached. In this manner, the information card 14 is easily at hand, and can be referenced by the user. In the preferred embodiment, the information card is placed within a protective sleeve 18. The protective sleeve is transparent, so that the information card can be read.

Figure 2:
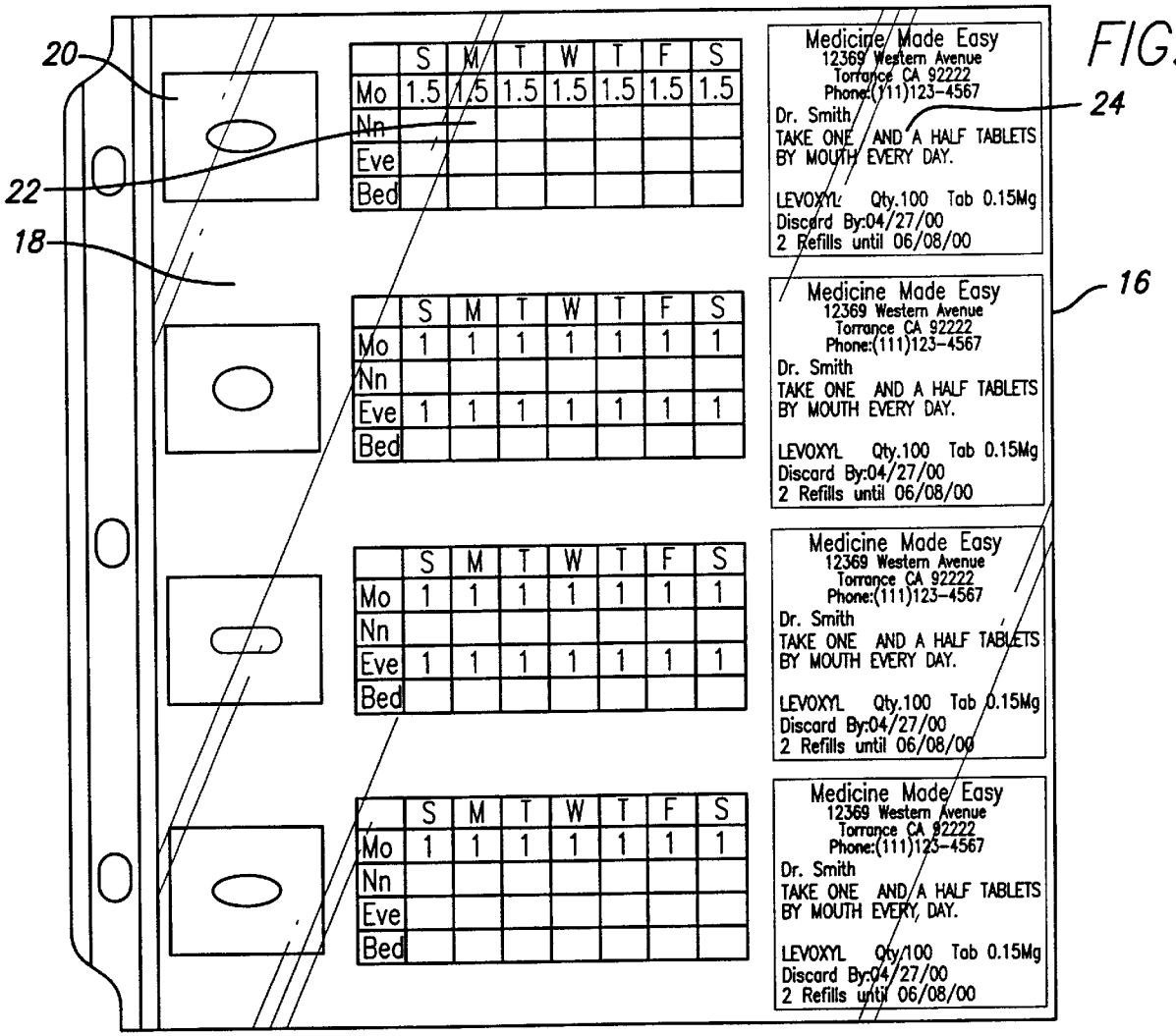
FIG. 2 is a detailed view showing a schematic representation of the information card of the present invention.
Figure 3:
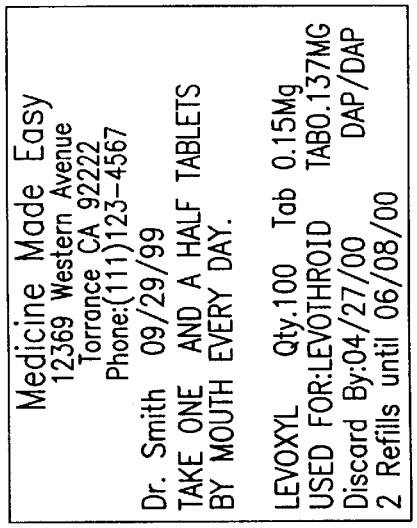
FIG. 3 is a detailed view showing sample data for particular medication on the information card of the present invention.

Referring next to FIG. 2, a schematic view of a typical information card is illustrated. The preferred embodiment of the information card 16 includes a written and visual description of the medication in the tray. For each different medication, at least three different information fields are provided. In the first field 20, a picture of the medication is shown. This picture permits the patient to easily identify each different medication. In the second field 22, a diagram is provided which clearly indicates where each type of medication is placed in the tray and the time period when the medication should be taken. The specific days, and time period (such as morning, noontime, evening, bedtime, mealtimes and the like) when each dosage is required is listed. FIG. 3 illustrates a sample table showing how the dosage information can be presented. Finally, in the third field 24, additional written information about the medication is provided. This written information can include the all of the information which is required by law to be included on all prescription medications.

It will be apparent to those skilled in the art, however, that the present invention can be practiced without all of these details. For example, the information card 16 may omit the written description of the medication, and provide only a photograph of the medicine. In other instances, it may be desirable to provide only a written description of the medication. In an alternative embodiment of the invention, the data on the information card is provided entirely in Braille, so that blind patients may also make use of the present invention. Additional data fields may also be added to the data card. For example, information concerning drug interactions, allergies specific to the patient, or other information such as "take with food" can be included.

Figure 4:
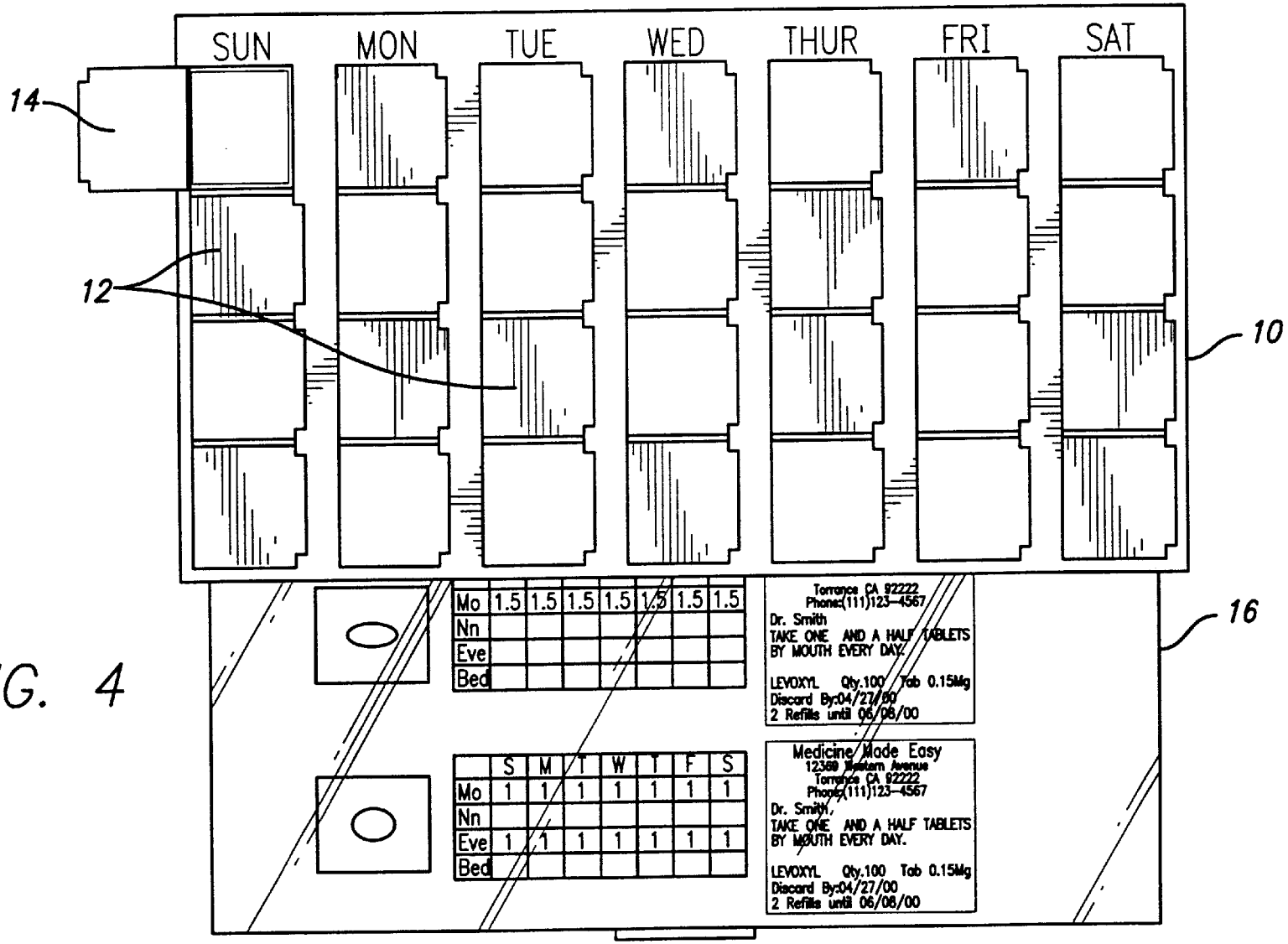
FIG. 4 illustrates an alternative embodiment of the present invention.
Figure 5:
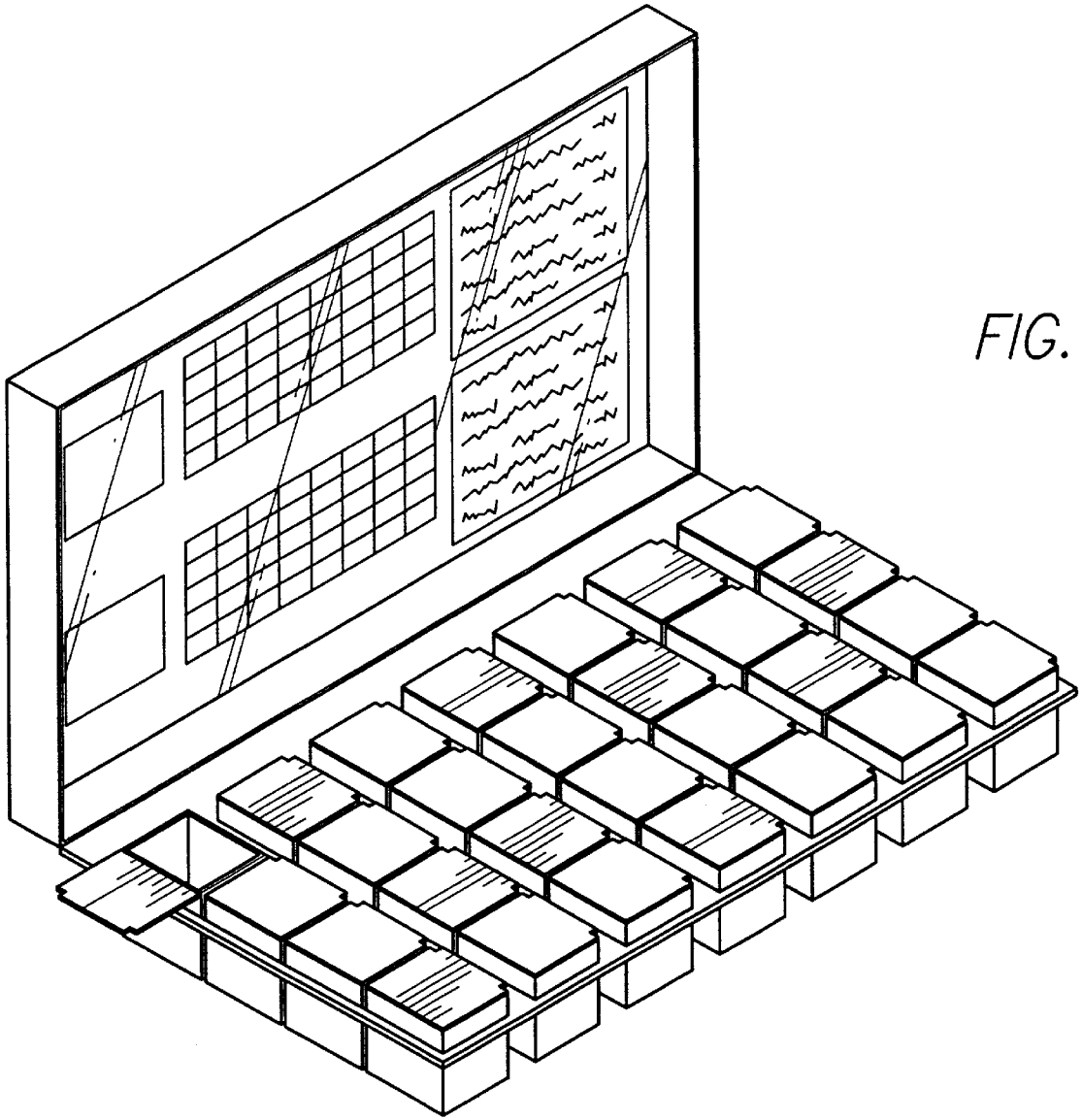
FIG. 5 illustrates an alternative embodiment of the present invention.

Referring again to FIG. 1, the preferred means for coupling the information card 16 to the dispensing tray 10 is illustrated as a ring. It is anticipated that the information card 16 may be coupled to the dispensing tray 10 in a variety of different ways. FIGS. 4 and 5 illustrate two different alternative methods of coupling the information card to the dispensing tray. FIG. 4 illustrates the information card 16 being attached underneath the dispensing tray. FIG. 5 illustrates the information card being attached to a cover which fits over the tray. The exact manner of coupling the information card 14 to the tray 10 is not critical. What is intended with the present invention is to provide a means of giving the patient information concerning the medicine to be taken which can be easily understood and quickly recognized.

The description of the present invention has been made with respect to specific arrangements and constructions of a medicine dispensing tray. It will be apparent to those skilled in the art that the foregoing description is for illustrative purposes only, and that various changes and modifications can be made to the present invention without departing from the overall spirit and scope of the present invention. The full extent of the present invention is defined and limited only by the following claims.

What is claimed is:

1. A medicine dispensing apparatus, comprising:

a medicine tray, said tray including at least two closeable compartments;

a plurality of different medications placed within said medicine tray;

an information card, said information card having printed thereon at least a pictorial representation of each of said medications and graphical information illustrating the placement of said different medications within said tray; and coupling means for attaching said medicine tray to said information card.

2. The device of claim 1, further comprising graphical information printed on said information card illustrating the quantity of each of said plurality of different medications within said medicine tray.

3. The device of claim 2 wherein said graphical information illustrating the location and quantity of each of said different medications is presented in a row and column format.

4. The device of claim 1, further comprising textual information printed on said information card relating to each of said plurality of different medications within said medicine tray.

5. The device of claim 3 wherein said textual information constitutes a pharmacy label for each different medication.

6. The device of claim 1 wherein said pictorial representation of said medications comprises photographs of said medications.

7. A medicine dispensing apparatus, comprising:

a medicine tray, said tray including at least two closeable compartments arranged in a grid pattern;

a plurality of different medications placed within said medicine tray;

an information card, said information card having printed thereon at least the following:

a photograph of each of said different medications, graphical information illustrating the location and quantity of each of said different medications within said tray, said graphical information being presented in a row and column format; and a pharmacy label relating to each of said different medications; and coupling means for attaching said medicine tray to said information card.

* * * * *